US005137282A

United States Patent [19]

Segar et al.

[11] Patent Number: 5,137,282

[45] Date of Patent: Aug. 11, 1992

[54] PLASTIC MOLDED ARROWHEAD AND METHOD

[75] Inventors: Donald E. Segar, Mt. Clemens; Guy R. Collins, Ypsilanti, both of Mich.

[73] Assignee: Folsom Sports, Inc., Mt. Clemens, Mich.

[21] Appl. No.: 638,060

[22] Filed: Jan. 7, 1991

[51] Int. Cl.[5] ..... F42B 6/08

[52] U.S. Cl. ..... 273/421

[58] Field of Search ..... 273/421, 422

[56] References Cited

U.S. PATENT DOCUMENTS

| | | | |
|---|---|---|---|
| 2,816,766 | 12/1957 | Stockfleth | 273/421 X |
| 4,143,876 | 3/1979 | Henkel | 273/422 |
| 4,928,969 | 5/1990 | Nagatori | 273/422 |

*Primary Examiner*—Paul E. Shapiro
*Attorney, Agent, or Firm*—Brooks & Kushman

[57] ABSTRACT

An insert molded arrowhead having orthogonal primary and secondary blades and a method for manufacturing the arrowhead are disclosed. The primary and secondary blades have slots adjacent their forward and rearward ends which interfit to form a blade assembly. The blade assembly is placed in a mold and insert molded with plastic. The plastic interlocks the interfitting blades, forms wedging ridges along cutting edges laterally disposed on the blade assembly, and encircles a stem member extending rearwardly from the blade assembly, forming a connector portion for securing the arrowhead to an arrow shaft.

22 Claims, 3 Drawing Sheets

PLASTIC MOLDED ARROWHEAD AND METHOD

TECHNICAL FIELD

This invention relates generally to insert molded arrowheads having primary and secondary blades, and particularly to an arrowhead that has wedging ridges located adjacent cutting edges of the primary blade.

BACKGROUND ART

A number of arrowheads have been disclosed utilizing insert molding techniques including U.S. Pat. Nos.: 2,676,017, 4,093,230, and 2,816,766. U.S. Pat. No. 4,234,191 shows an all plastic molded arrowhead.

None of this prior art has met with any substantial commercial success, in part, we believe because of a combination of reasons including cost, strength of the arrowhead for its weight, lack of ability to open a killing wound, complexity of design and manufacture, and difficulty in mounting or demounting the heads of arrowshafts. We believe the arrowhead shown herein overcomes the aforementioned drawbacks of the prior art because of its unique design and construction.

DISCLOSURE OF THE INVENTION

This invention includes an insert molded arrowhead having primary and secondary blades each generally triangularly shaped and orthogonally interfitting with each other, and a method for making the same.

The primary blade has a rearwardly extending stem member and a central opening with forward and rearward slots which cooperate with front and back slots on the secondary blade which is received in the central opening to form an interfitting blade assembly. The blade assembly is then placed into a mold and a resin is molded in situ about the assembly to integrate it. The plastic or resin not only interlocks the interfitting blades, but also forms wedging ridges adjacent the cutting edges of the primary blade, and further forms a hub and shaft which encircle the stem member, with the shaft having an extension for releasably securing to an arrow shaft.

As the arrowhead impacts an object, the cutting edges initiate small thin openings. The trailing wedging ridges widen the openings and enhance the penetratability of the arrowhead. Accordingly, this increases the lethalness of the arrowhead when used for hunting game.

An object of the present invention is to provide a primary and a secondary blade having cooperating slots located adjacent their forward and rearward ends, forming an interfitting orthogonal blade assembly, the assembly being structurally stable and easily inserted into a mold.

Another object is to provide an insert molded arrowhead which has an integrally molded rearwardly extending plastic threaded extension which is releasably securable to an arrow shaft.

Yet a further object is to provide wedging ridges located parallel cutting edges to widen wounds initiated by the cutting edges and enhance the penetratability of the arrowhead.

Still another object is to provide an arrowhead that has central openings in both the interlocking secondary and the primary blades with a minimum of molding plastic holding the blades together, resulting in a very light-weight yet structurally strong arrowhead.

Yet a further object is to provide an arrowhead that is easily manufactured and cheaper to produce than other arrowheads.

BEST MODE FOR CARRYING OUT THE INVENTION

This invention includes an insert molded arrowhead 20 having a metal primary blade 22 and a metal secondary blade 24 which are orthogonally interfitted and then encapsulated in a plastic. Preferably, the plastic is one sold by the General Electric Company under the trademark "LEXAN", type ML 4291. Primary blades 22 and secondary blade 24 are preferably made of a tempered hardened steel.

Figure 7:
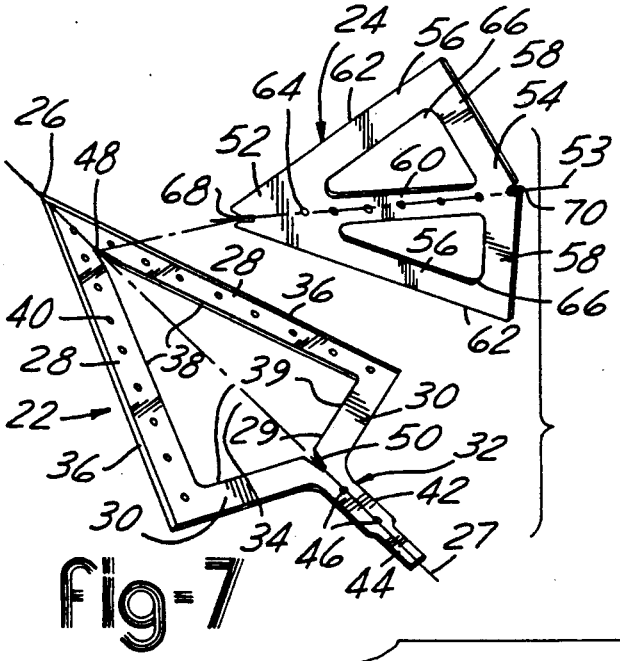
FIG. 7 is an exploded perspective view of a secondary blade and a primary blade prior to their assembly.

Primary blade 22, as best seen in FIG. 7, is essentially a planar triangular member having a central opening 34 defining a continuous peripheral marginal portion having an apex 26 at one end and a base 30 at the opposite end. The blade has a longitudinal axis 27 extending from the apex 26 to stem member 32. Side portions 28 intersect integrally along the longitudinal axis 27 adjacent apex 26 and extend rearwardly and laterally outwardly therefrom. Portions 30 extend laterally inwardly and slightly rearwardly from the rearward end of the side portions 28, integrally intersecting along the longitudinal axis 27. Stem member 32 extends axially rearwardly from the intersection of the rearward portions 30. The central opening 34 is defined by the inner edges 38 of side portions or members 28 and the inner edges 39 of the rearward portions or members.

Each side member 28 has a cutting edge 36, located on the lateral outside edges of side member 28, an inner side portion 38 laterally inwardly disposed from cutting edge portion 36, and a plurality of side apertures 40 located longitudinally along inner side portion 38.

Stem member 32 has a stem portion 42 and a tongue portion 44. Stem portion 42 contains longitudinally spaced stem apertures 46. Tongue portion 44 is narrower than and is rearwardly disposed of stem portion 42.

Forward slot 48, is located adjacent the intersection of side members 28, and rearward slot 50, is located adjacent the intersection of rearward members 30. Forward slot 48 and rearward slot 50 open into central opening 34 and are located along the longitudinal axis 27.

Secondary blade 24, as best seen in FIG. 7 is essentially a planar triangle and comprises a front end 52, a back end 54, flank members 56, back members 58 and axial member 60. Longitudinal axis 53 extends from front end 52 to back end 54. Flank members 56, which are laterally disposed from each other and axial member 60 integrally intersect at front end 52. Flank members 56 extend rearwardly and laterally outwardly from front end 52. Axial member 60 extends rearwardly from front end 52 along longitudinal axis 53. Back members 58 connect with the rearward ends of flank members 56 and extend laterally inwardly and slightly rearwardly therefrom, intersecting with axial member 60 at rearward end 54. Flank members 56 have slicing edges 62 located on their laterally outward edges. Axial member 60 has axial apertures 64 spaced along longitudinal axis 53. A pair of secondary openings 66 are formed by the inner edges of the flank members 56 and back members 58 and the lateral outside edges of axial member 60, respectively.

A front slot 68 is located at the front end 52 and rear slot 70 is located at the rear end 54. Front and rear slots 68 and 70, respectively, open longitudinally outwardly and are sized to cooperatively interfit with forward slot 48 and rearward slot 50, respectively, when the secondary blade 24 is interfitted with primary blade 22.

Figure 2:
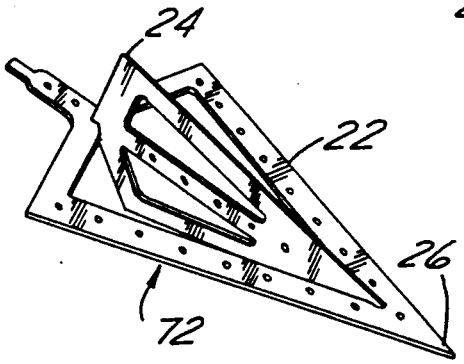
FIG. 2 is a perspective view of a blade assembly comprising a primary and a secondary blade.
Figure 8:
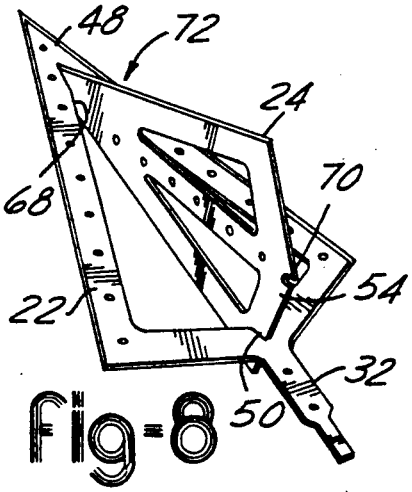
FIG. 8 is a perspective view of a secondary blade partially assembled within a primary blade.

A blade assembly 72, as shown in FIG. 8, is formed by the orthogonal interfitting of secondary blade 24 within primary blade 22. Front slot 68 is slottingly engaged in forward slot 48 with the laterally outward end of one of the back members 58 loosely inserted into rearward slot 50. Back slot 70 is then translated inwardly toward rearward slot 50 until they snap into engagement with one another. FIG. 2 illustrates a perspective view of the completed blade assembly 72. Preferably the cutting edges 36 and slicing edges 62 are sharpened prior to assembly of the blades.

Blade assembly 72 may handled with considerable vigor without causing disassembly, thereby enhancing the ease of manufacture of arrowhead 20. In the event blade assembly 72 is to be disassembled, secondary blade 22 must be pushed firmly forward and stem member 32 pulled rearwardly while pulling or pushing back end 54 laterally sideways to disengage back slot 70 from rearward slot 50.

Figure 1:
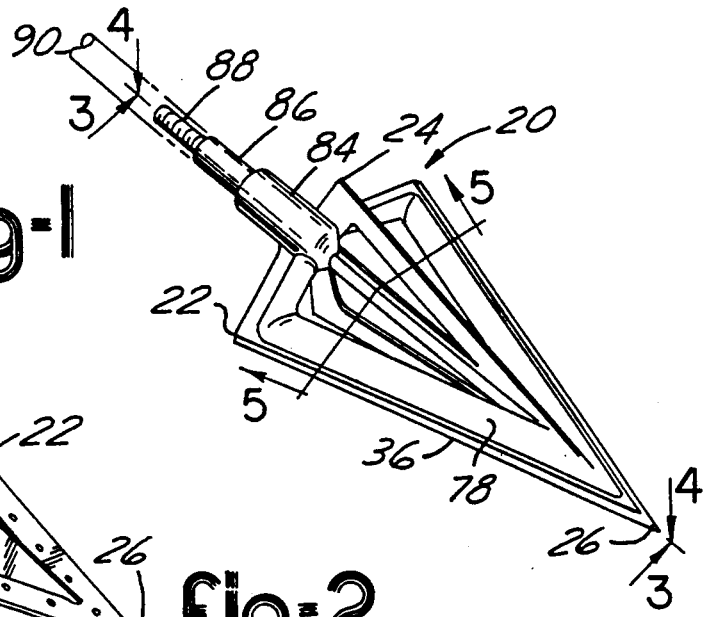
FIG. 1 is a perspective view an insert molded arrowhead made in accordance with the present invention.
Figure 5:
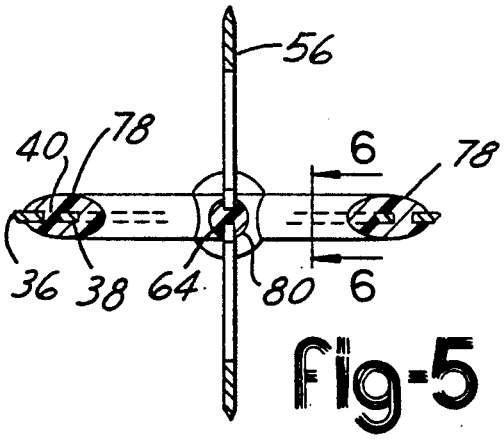
FIG. 5 is a sectional view taken along 5—5 of FIG. 1.
Figure 9:
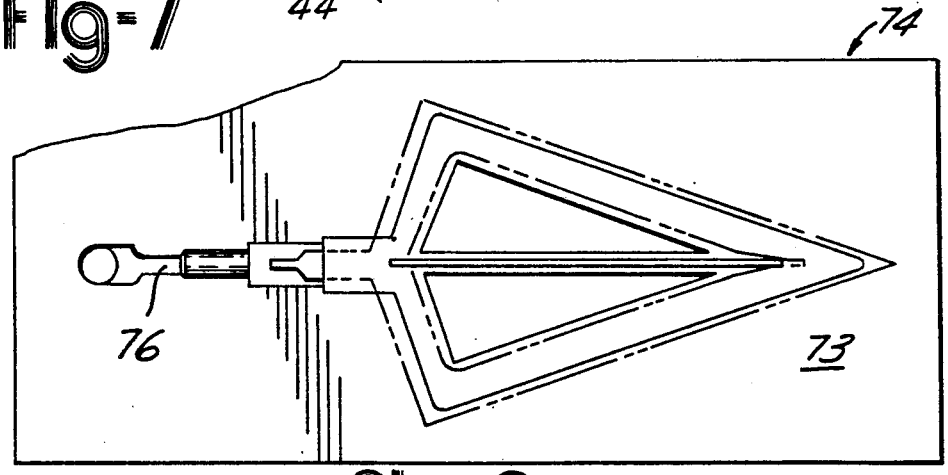
FIG. 9 is a top elevational view of the lower half of a mold used in the insert molding of this invention.
Figure 10:
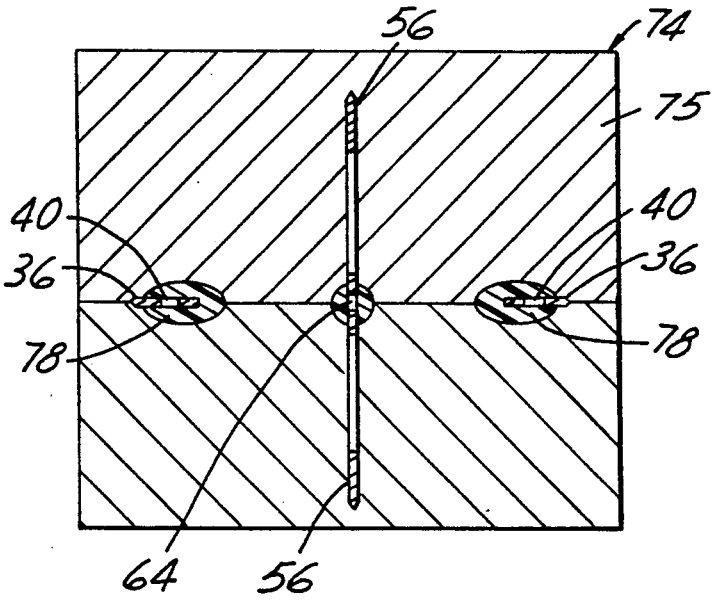
FIG. 10 is a sectional view of the upper and lower halves of a mold, used in this invention, with a blade assembly located therein.

To finish the manufacture of arrowhead 20, blade assembly 72 is placed in a mold assembly 74 and insert molded as shown in FIGS. 9 and 10. FIG. 9 illustrates the lower half 73 of mold assembly 74, with the upper half 75, being a mirror image with the exception of an inlet gate 76. Mold assembly 74 is shown in solid lines and the blade assembly 72 in broken lines in FIG. 9. FIGS. 1, 5 and 10 shows that the side apertures 40 and an axial aperture 64 are bisected, with the interlocking of resin about primary blade 22 and secondary blade 24 at their interconnection adjacent the apex 26 and base 30 of the primary blade.

Figure 4:
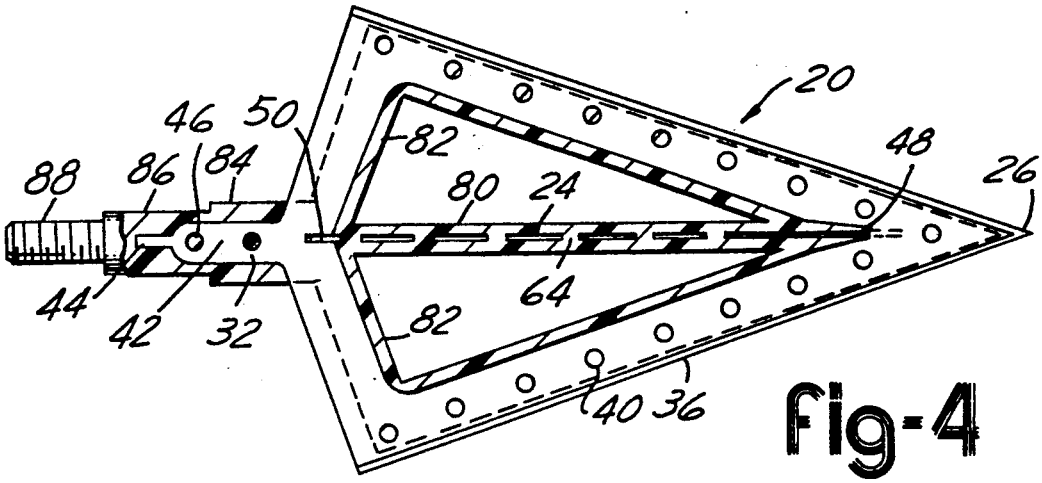
FIG. 4 is a top sectional view taken on line 4—4 of FIG. 1.
Figure 6:
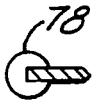
FIG. 6 is a sectional view taken on line 6—6 of FIG. 5.

FIGS. 1 and 5 show that oval-shaped wedging ridges 78 are formed in situ around inner side edges 38 of side members 28 and interlock through side apertures 40. The cutting edge portion 36 remains free of any plastic. Flank member 56 also remains free of plastic. Axial member 60 has a semi-circular mound 80 located on each of its planar surfaces, the mound 80 interlocking through axial apertures 64. FIG. 6 demonstrates that rearward members 30 have a circular crest 82 about their inner longitudinal edges which are adjacent central opening 34. FIG. 4 shows a cylindrical hub 84 and a shaft 86, encircling stem member 32, with a threaded extension 88 extending rearwardly from shaft 86. Plastic also passes through stem apertures 46, interlocking hub 84 and shaft 86 about stem member 32.

Figure 3:
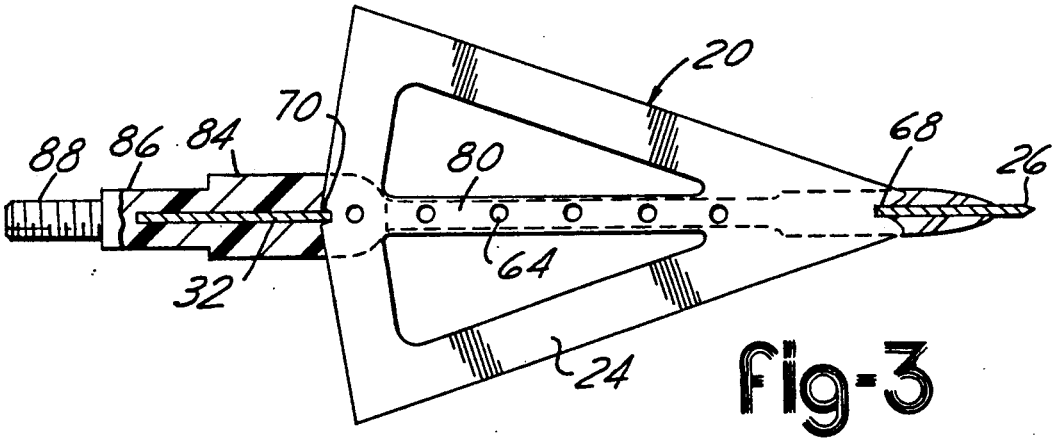
FIG. 3 is a side sectional view taken on line 3—3 of FIG. 1.

FIGS. 3 and 4 illustrate that forward slot 48 and front slot 68 are encapsulated by plastic formed from the intersection of wedging ridges 78 and mounds 80 adjacent apex 26. Similarly, rearward slot 50 and back slot 70 are fixedly secured by their encapsulation within the combination of hub 84, mound 80 and crest 82 adjacent the base 30.

FIG. 1 shows an arrow shaft 90 securing to arrowhead 20. Threaded extension 88 threadedly attaches to female threads within arrow shaft 90 with a hollow end of arrow shaft 90 sliding snugly over shaft 86 for additional support. Other designs may also be utilized for attaching the arrowhead to an arrow shaft.

In operation, the arrowhead 20 is attached to an arrow shaft 90 and fired from a bow. The cutting edges 36 and slicing edges 62 initiate thin openings. The wedging ridges 78 enter the openings created by cutting edges 36 and expand them. The larger opening enhances the penetratability of the arrowhead.

Tests were conducted to compare arrowheads of our design with a commercially available arrowhead of good quality, a Rocky Mountain Supreme. The tests included firing arrows from a compound bow, set at 57 lbs., into ½" thick plywood boards at a distance of 20 yards, with the following results:

| Present Invention | |
|---|---|
| Arrowheads partially protruding from opposite side of board with considerable splintering. No breakage or separations of the arrowhead | Arrowhead, in some instances, broke or separated in the board. |

Figure 11:
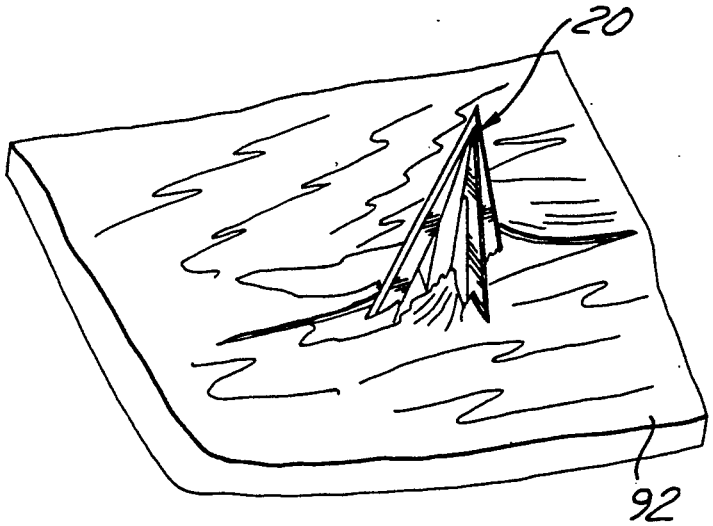
FIG. 11 is a perspective view of an arrowhead, made in accordance with this invention, fired into a plywood sheet.
Figure 12:
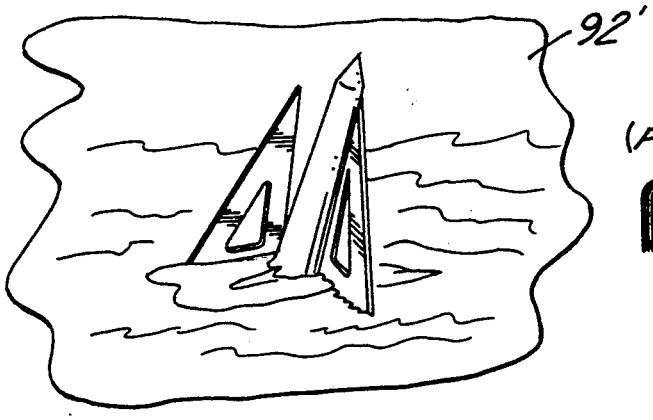
(PRIOR ART) Fig-12
FIG. 12 is a perspective view of a prior art arrowhead which broke apart under identical test firing conditions as that used in the firing of the arrowhead of FIG. 11.

It is our belief that the plastic molding around the inside edges 38 and 39 of the primary blade, which increases the thickness of the blade, causes a greater opening of the hole in the board as the arrow passes through, than occurs with the prior art or the commercially available arrowheads. This is depicted in FIGS. 11 and 12. FIG. 11 shows a view of an arrowhead 20, made in accordance with this invention, shot into a piece of plywood 92. The arrowhead achieved substantial penetration without breakage or disassembly. Contrarily, in FIG. 12, another arrowhead 21 (a Rocky Mountain Supreme) disassembled under the same test firing condition. Repeated tests were made and our arrowhead, even shot at 85 lbs. @20 yards, did not break. At the same time our arrowhead opened up a much larger hole in the plywood than the prior art arrowhead we tested. At the 85 lbs. setting, arrows passed completely through plywood without damage.

What is claimed:

1. An arrowhead securable to an arrow shaft comprising:

a primary blade having a generally continuous outer periphery with a central opening formed therein, a forward portion with an apex and a rearward portion, a longitudinal axis extending from the apex to the rearward portion, a forward slot located in the forward portion, and a rearward slot located in rearward portion, and wherein the forward and rearward slots extend longitudinally axially and open interiorly into the central opening;

a secondary blade having a generally continuous outer periphery, a front portion, a back portion, a longitudinal axis extending from the front portion to the back portion, a front slot located in the front portion, a back slot located in the back portion, wherein the front and rear slots extend longitudinally axially and open exteriorly from the periphery and wherein the forward and front slots and the rearward and back slots cooperatively interfit to orthogonally locate the secondary blade within the central opening of the primary blade in an angularly related relation; and plastic encapsulating the forward and front slots and the rearward and back slots wherein the secondary blade is fixedly secured to the primary blade.

2. The arrowhead as recited in claim 1 wherein the primary blade and the secondary blade are orthogonally disposed one another.

3. The arrowhead as recited in claim 1 wherein the primary blade further comprises a stem member extending axially rearwardly from the rearward portion and wherein the stem member is also encapsulated in plastic forming a shaft having a extension for securement with an arrow shaft.

4. The arrowhead as recited in claim 3 wherein the extension is threaded.

5. The arrowhead as recited in claim 1 wherein the periphery and the central opening of the primary blade are defined by a pair of side members extending rearwardly and laterally divergently from the apex and a pair of rearward members extending from the rear ends of side members laterally inwardly to the longitudinal axis, each side member having a sharpened cutting edge disposed on its laterally outward edge and vertical plastic wedging ridges spaced laterally inwardly and parallel to the cutting edge on each planar surface of the side member, the width of the wedging ridges being substantially less than the width of the primary blade.

6. The arrowhead as recited in claim 5 wherein at least one side member contains at least one side aperture wherein the wedging ridges interlock through the aperture about the planar surfaces of the side member.

7. The arrowhead as recited in claim 1 wherein the metal is a tempered hardened steel.

8. The arrowhead as recited in claim 1 wherein the plastic is "LEXAN".

9. An arrowhead for attachment to a shaft, the arrowhead comprising:

a central attaching hub and a planar blade, the attaching hub affixed to the blade and being adapted to attach to a shaft, the blade having a forward apex leading to two trailing diverging sharpened cutting edges, the arrowhead having at least one vertical wedging ridge juxtaposed and extending parallel along a cutting edge and spaced from the attaching hub, wherein the ridge provides increased thickness and wound enhancement.

10. The arrowhead as recited in claim 9 wherein the arrowhead has a vertical wedging ridge on each of the planar surfaces of the blade the wedging ridges juxtaposed and extending parallel along at least one cutting edge.

11. The arrowhead as recited in claim 10 further comprising at least one aperture in the blade through which the vertical wedging ridges interlock about the blade.

12. The arrowhead as recited in claim 9 wherein the wedging ridge is made of plastic.

13. A method of making an arrowhead comprising the steps of:

providing a planar primary blade having an enclosed central opening, a forward slot and a rearward slot, the slots extending along the longitudinal axis of the primary blade and opening into the central opening;

providing a planar secondary blade having a front and back slots extending along the longitudinal axis of the secondary blade and opening exteriorly; wherein the forward slot and the front slot and the rearward slot and the back slot are cooperatively interfitting to secure the secondary blade in an angularly related relation within the primary blade; and encapsulating with plastic the interfitting forward and front slots and the interfitting rearward and back slots to fixedly interlock the secondary blade within the primary blade.

14. The arrowhead as recited in claim 13 wherein the primary blade and the secondary blade are orthogonally disposed one another.

15. The method as recited in claim 13 further comprising the step of forming a vertical plastic wedging ridge on at least one planar surface of the primary blade, the ridge being spaced laterally inwardly and parallel along a cutting edge.

16. The method as recited in claim 15 wherein there is a stem member extending rearwardly from the rearward slot and encapsulating such stem member in plastic forming a shaft having a rearwardly extending extension for mounting to a an arrow shaft.

17. The method as recited in claim 16 wherein the extension is threaded.

18. An arrowhead for securement to an arrow shaft comprising, in combination:

a primary blade of generally triangular planar configuration having a central opening defining a continuous peripheral marginal portion having an apex at one end and a base at the opposite end;

a secondary blade of generally triangular planar configuration having a continuous peripheral marginal portion and received in the central opening of the primary blade in angularly related relations and connected therewith adjacent the apex and adjacent the base;

a resin molded in situ about the blades at their connection adjacent the apex and the base of the primary blade to lock the blades together and extending along the continuous peripheral marginal portion of one of the blades to provide increased thickness and wound enhancement; and means at the base for connecting the arrowhead to an arrow shaft.

19. An arrowhead as recited in claim 18 wherein the resin extends along the continuous peripheral marginal portion of the primary blade adjacent the central opening.

20. An arrowhead as recited in claim 18 wherein said resin extends along the continuous peripheral marginal portion of the primary blade adjacent the central openings.

21. The invention defined by claim 18 characterized in that said resin is molded in situ along a continuous peripheral marginal portion adjacent said central opening to define an increased thickness for the blade.

22. The invention defined by claim 18 wherein said resin adjacent the base is shaped to provide a connection for an arrowshaft.

* * * * *